US012788148B1

(12) United States Patent
Balz et al.

(10) Patent No.: US 12,788,148 B1
(45) Date of Patent: Nov. 10, 2026

(54) CUSHION SYSTEMS AND METHODS FOR OPERATING CUSHION SYSTEMS

(71) Applicant: Kalogon, Inc., Melbourne, FL (US)

(72) Inventors: Timothy Balz, Melbourne, FL (US); Christian Balcom, Cocoa, FL (US); Connor Crenshaw, Orlando, FL (US)

(73) Assignee: Kalogon, Inc., Melbourne, FL (US)

( * ) Notice: Subject to any disclaimer, the term of this patent is extended or adjusted under 35 U.S.C. 154(b) by 316 days.

(21) Appl. No.: 18/386,215

(22) Filed: Nov. 1, 2023

Related U.S. Application Data

(60) Provisional application No. 63/421,498, filed on Nov. 1, 2022.

(51) Int. Cl.
*A47C 7/14* (2006.01)
*A47C 31/12* (2006.01)

(52) U.S. Cl.
CPC ..... *A47C 7/142* (2018.08); *A47C 31/126* (2013.01)

(58) Field of Classification Search
CPC ..... A47C 7/142; A47C 31/12
See application file for complete search history.

(56) References Cited

U.S. PATENT DOCUMENTS

| | | | | |
|---|---|---|---|---|
| 2017/0249559 | A1* | 8/2017 | Herzog | G06N 5/048 |
| 2018/0311095 | A1* | 11/2018 | Bednarz, III | A61G 7/05776 |
| 2019/0193591 | A1 | 6/2019 | Migneco et al. | |
| 2020/0085673 | A1 | 3/2020 | Seo et al. | |
| 2021/0059426 | A1* | 3/2021 | Bussert | A47C 7/142 |
| 2021/0345968 | A1 | 11/2021 | Autar et al. | |
| 2022/0048632 | A1* | 2/2022 | Aviv | B60N 2/60 |
| 2024/0016301 | A1* | 1/2024 | Karschnik | A47C 21/04 |

FOREIGN PATENT DOCUMENTS

KR 20180125057 A 11/2018

* cited by examiner

*Primary Examiner* — Michael W Choi
(74) *Attorney, Agent, or Firm* — Scale LLP

(57) ABSTRACT

Cushion systems and methods for operating cushion system are disclosed. In an embodiment, a cushion system includes a cushion having at least one sensor disposed to sense an air mass in the cushion and an air mass controller configured to control the air mass within the cushion. The cushion system also includes a processor configured to receive sensor data from the at least one sensor, predict a state of the cushion in response to the sensor data, and provide a command to the air mass controller within the cushion in response to the predicted state.

21 Claims, 3 Drawing Sheets

CUSHION SYSTEMS AND METHODS FOR OPERATING CUSHION SYSTEMS

CROSS-REFERENCE TO RELATED APPLICATION

This application claims priority to provisional U.S. Patent Application Ser. No. 63/421,498, filed Nov. 1, 2022, which is incorporated by reference herein.

BACKGROUND

A problem that has arisen in the context of modeling complex systems is that the ability to determine a state of the system is more complex than the number of sensors that can determine individual features desired to be measured. This problem can arise in a number of contexts, particularly discontinuous and/or nonlinear systems, and especially systems in which distinguishing between substantially different states can be difficult to tell with a limited number of sensors.

SUMMARY

Cushion systems and methods for operating cushion system are disclosed. In an embodiment, a cushion system includes a cushion having at least one sensor disposed to sense an air mass in the cushion and an air mass controller configured to control the air mass within the cushion. The cushion system also includes a processor configured to receive sensor data from the at least one sensor, predict a state of the cushion in response to the sensor data, and provide a command to the air mass controller within the cushion in response to the predicted state.

In an example, the air mass controller includes a pump configured to inflate a bladder of the cushion in response to the command.

In an example, the air mass controller includes a valve configured to deflate a bladder of the cushion in response to the command.

In an example, the air mass controller includes a pump configured to deflate a bladder of the cushion in response to the command.

In an example, the processor is configured to predict that the cushion has a leak in response to the sensor data.

In an example, the processor is configured to predict that a user of the cushion is pressing against a supporting surface underneath the cushion.

In an example, the processor is configured to predict that a user of the cushion has exited the cushion.

In an example, the processor is configured to predict that the cushion is no longer operational.

In an example, the processor is configured to predict that a user of the cushion is pressing against a supporting surface underneath the cushion, and wherein the air mass controller includes a pump configured to inflate a bladder of the cushion in response to the command that is generated based on the prediction that the user of the cushion is pressing against a supporting surface of the cushion.

In an example, the processor is further configured to implement multiple state prediction experiments and to select a state prediction model from the multiple state prediction experiments in response to an evaluation of an accuracy of state predictions generated from the multiple state prediction experiments.

In an example, the processor is configured to determine an accuracy of a state prediction using historical sensor data.

In an example, the cushion includes multiple bladders, each bladder including a bladder-specific sensor, and wherein the processor receives bladder-specific sensor data from the multiple bladders.

In an example, the processor is configured to provide bladder-specific commands in response to the bladder-specific sensor data.

A method for operating a cushion system is also disclosed. The method includes generating sensor data at a sensor of a cushion, wherein the sensor is configured to sense an air mass in the cushion, receiving the sensor data at at least one processor of the cushion system, predicting, at the at least one processor of the cushion system, a state of the cushion in response to the sensor data, generating, at the at least one processor of the cushion system, a command in response to the predicted state of the cushion system, and adjusting an air mass within the cushion in response to the command.

In an example, adjusting the air mass within the cushion involves inflating at least one bladder of the cushion in response to the command.

In an example, adjusting the air mass within the cushion involves deflating at least one bladder of the cushion in response to the command.

In an example, predicting the state of the cushion involves predicting that the cushion has a leak in response to the sensor data.

In an example, predicting the state of the cushion involves predicting that the cushion is pressing against a supporting surface underneath the cushion.

In an example, predicting the state of the cushion involves predicting that a user of the cushion has exited the cushion.

In an example, predicting the state of the cushion involves predicting that the cushion is no longer operational.

In an example, adjusting the air mass within the cushion involves inflating multiple bladders of the cushion in response to bladder-specific commands.

In an example, adjusting the air mass within the cushion involves deflating multiple bladders of the cushion in response to bladder-specific commands.

In an example, the method further involves implementing multiple state prediction experiments and selecting a state prediction model from the multiple state prediction experiments in response to an evaluation of an accuracy of state predictions generated from the state prediction experiments. In an example, the method further involves determining an accuracy of a state prediction using historical sensor data.

Other aspects in accordance with the invention will become apparent from the following detailed description, taken in conjunction with the accompanying drawings, illustrated by way of example of the principles of the invention.

BRIEF DESCRIPTION OF THE DRAWINGS

Throughout the description, similar reference numbers may be used to identify similar elements.

DESCRIPTION OF EMBODIMENTS OF THE INVENTION

Figure 1:
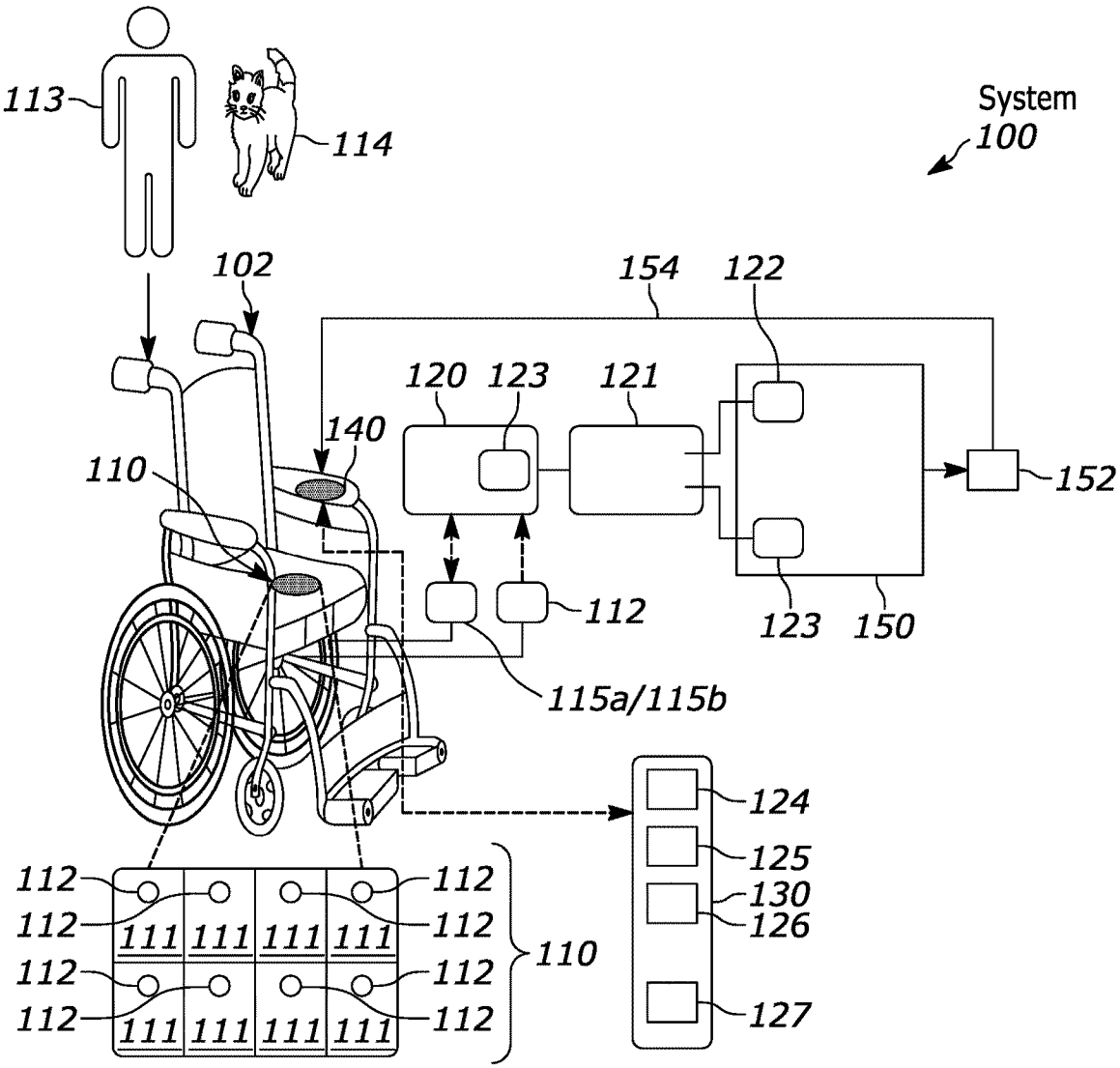
FIG. 1 depicts an example of a system that includes a cushion system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

The following terms and phrases are exemplary only, and not limiting.

The phrases "this application", "this description", and variants thereof, generally refer to any material shown or suggested by any portions of this Application, individually or collectively, and including all inferences that might be drawn by anyone skilled in the art after reviewing this Application, even if that material would not have been apparent without reviewing this Application at the time it was filed.

The phrases "handheld computing device", "handheld phone", "mobile computing device", "mobile device", and variants thereof, generally refers to any relatively portable device disposed to receive inputs from and provide outputs to, one or more users. For example, a mobile device can include a smartphone, an MP3 player, a laptop or notebook computer, a computing tablet or phablet, or any other relatively portable device disposed to be capable as further described herein. The mobile device can include input elements such as a capacitive touchscreen; a keyboard; an audio input; an accelerometer or haptic input device; an input couplable to an electromagnetic signal, to an SMS or MMS signal or a variant thereof, to an NFC or RFID signal or a variant thereof, to a signal disposed using TCP/IP or another internet protocol or a variant thereof, to a signal using a telephone protocol or a variant thereof; another type of input device; or otherwise.

The terms "prediction", "predictive", and variants thereof, may generally refer to any significant relationship between a measurement to be made in the future, and an actual value of that measurement when it is eventually made. The terms "prediction", "predictive", and variants thereof, may also refer to a state of a cushion system at some time in the future that is predicted from some set of actual sensor data using a system model.

The terms "pseudo-random", "random", and variants thereof, may generally refer to any process or technique having a substantially nonpredictable result. The term "random", and variants thereof, can include pseudo-random processes and functions.

The phrases "remote device", "logically remote device", "physically remote device", and variants thereof, may generally refer to any device disposed to be accessed, and not already integrated into the accessing device. For example, a remote device can include a database or a server, or another device or otherwise, coupled to a communication network, accessible using a communication protocol. For another example, a remote device can include one or more mobile devices, accessible using a telephone protocol, a messaging protocol such as SMS or MMS or a variant thereof, an electromagnetic signal such as NFC or RFID or a variant thereof, an internet protocol such as TCP/IP or a variant thereof, or otherwise.

The phrase "user input", and variants thereof, may generally refer to information received from the user, such as in response to audio/video conditions, requests by other persons, or otherwise. For example, user input can be received in response to an input device (whether real or virtual), a gesture (whether by the users' eyes, hands, or otherwise), using a smartphone or controlling device, or otherwise.

After reviewing this Application, those skilled in the art would recognize that these terms and phrases should be interpreted in light of their context in the specification.

Inflatable/deflatable cushions. An example of a complex system, which is described herein, includes an inflatable/deflatable cushion, for which it can be difficult to tell a difference between, for example, a state of the cushion which is excessively deflated because the cushion has a leak, or a state of the cushion in which a user is "bottomed out", that is, is resting their bony parts or muscles against a hard supporting surface), or a state of the cushion in which the user has exited the cushion and is no longer resting thereon, or at state of the cushion in which the user has turned off the cushion's pumping systems and the cushion is no longer operational. In many such cases, it can be difficult to determine whether the cushion is in a first state, which is relatively benign, and a second state, which is relatively dangerous to the user. However, distinguishing between benign states and dangerous states can be important to whether the user is subject to the possibility of serious injury.

Patients and other users who have restricted mobility, whether they have restricted mobility or are otherwise fully mobile but with difficulty, or who otherwise have difficulty obtaining comfortable seating, might sometimes be subject to adverse medical conditions, such as pressure sores and/or decubitus ulcers. These conditions, left undetected or untreated, can involve serious adverse consequences, such as loss of muscle mass, serious infection, and even death.

Also, even when fully mobile users remain seated, or are otherwise restrained, for an extended time duration, such as being confined to a hospital bed, to a wheelchair, or to a car seat or an airline seat, those users might be subject to "seating fatigue", possibly leading to cramped muscles, pain, sores, or other discomfort, even for completely healthy persons. For example, persons who participate in extended automobile or airline travel might find it necessary to leave their seats and stretch periodically. This can be difficult in a moving vehicle or when the user is otherwise temporarily constrained.

Accordingly, it would be advantageous to provide methods and systems that can be responsive to those patients and other users, such as to allow for more extended seating without discomfort and without the user's desire for breaks. It would be further advantageous to provide methods and systems that, in addition to being responsive to such patients, can be relatively accommodating to user needs or preferences, can be relatively inexpensive in comparison with known devices.

Other complex systems. Similarly, other such complex systems can include vehicles operating under (at least partial) control of an artificial intelligence or machine learning (AI/ML) system, such as a vehicle having cruise control, an autonomous vehicle, a surveillance drone, a law enforcement or military assistance drone used to seek out targets for capture or destruction, firefighting and/or search and rescue drone used to seek out targets for assistance, or other systems such as described herein.

Similarly, other such complex systems can include complex systems such as explosive control or triggering systems, network control/monitoring systems or other computer-controlled communication or control systems, oil refineries or other chemical factories/processors, or otherwise as described herein. Each of these types of systems can have the properties that their operations are difficult to predict (particularly in being substantially nonlinear or catastrophic in their operations), that adequate sensor information can be difficult to obtain (sometimes due to inability to emplace sensors where they would be sufficient to provide adequate information), and for which enhanced information from relatively simple sensors or sets of sensors would be vastly superior to unenhanced information.

Artificial intelligence or machine learning (AI/ML) systems themselves can be included in complex systems for which the number of sensors does not reasonably provide the amount of information desirable to understand and control the state of the system itself, and for which enhancement of sensor information could be valuable in determining whether the system is operating in a state in which its results can be used confidently for the purpose for which they were designed.

Similarly, other such complex systems can include the human body, particularly when devices or systems are used to perform medical operations such as surgery, laparoscopic surgery, exploratory surgery, or other types of medical operations. Similarly, other such complex systems can include medical control systems such as pacemakers, drug injection systems, or alarm systems designed to alert emergency responders and/or other medical personnel in the event that the human body undergoes an untoward status change for which urgent response is desirable.

Enhanced sensor data. Data from one or more sensors providing information can be collected in an historical sequence, such as a status record of a substantially complex system. A model of the complex system, suitable for forward computation, can be applied to the historical sequence of the data collected from the sensors, to provide a "prediction" of how the system should behave in response to the data collected from the sensors. The term "prediction" is from the perspective of how the system is expected to behave before the entire historical sequence of data is collected, thus, in response to a portion of that historical sequence and determining a likely future of the system after that portion of the historical sequence has been collected.

Models of system behavior. A set of system models of the actual state of a system, each consistent with the data from one or more sensors of the system, can be constructed in response to the actual data and from the "prediction" of how the system should behave in response to that data. Each such system model (also referred to as a state prediction model) can be measured for accuracy and/or other likelihood factors (e.g., such as surprise, consistency with past behavior, distinction with believed physical models of the system, or other factors as described herein). The models can be ranked in terms of believed superiority and a current-best model selected to determine which model should be used to exert controls or issue commands/instructions to the system for most-likely best behavior. Consistency with believed models of system behavior, or surprise with respect to unexpected system behavior, can be factored into measures of whether each model of the actual state of the system is more/less likely to be accurate.

Comparison with further sensor data. As additional sensor data is collected, each collection of system models can be compared with the additional sensor data to determine whether it continues to be consistent with that sensor data. Selected system models can be added and/or discarded as they are determined to be better/worse than the set of current-best models. An "accuracy" score or other current-best system model score can be maintained and the current-best system models can be maintained in a data structure which best allows for selecting those system models which are deemed superior to be maintained for comparison with further sensor data.

Offloading computation. A set of separate system models can be maintained for distinct uses, such as possibly a first model which is relatively easy to compute and uses relatively little power, and a second model which is relatively harder to compute and uses relatively more power, but which is substantially more accurate. When the first model is inadequate to provide a reliable prediction of system behavior in response to historical data, the enhanced sensor can offload at least some computation to other computing resources to obtain a more reliable prediction of system behavior from the second model. Similarly, a first and a second model, each relatively easy to compute and using relatively little power, can be used to each provide a separate prediction of system behavior; when those first and second models sufficiently disagree, a more robust model which is relatively harder to compute and uses relatively more power can be used to distinguish between the first and second models. Offloading computation can be performed to a logically or physically remote computing device, or can be performed by allocating relatively more local devices to perform computing for the selected system model.

Inflatable/deflatable cushions. One complex system disclosed herein includes an inflatable/deflatable cushion that may be characterized as having various different states, for which it can be difficult to tell from just a set of pressure sensors (1) whether the cushion has a leak, (2) whether the user is "bottomed out", (3) whether the user has exited the cushion, (4) whether the cushion is no longer operational, (5) whether one or more sensors is not operating accurately, or (6) whether some other issue has arisen with operation of the system. It is desirable to determine which of many such states is accurate, as some such states can be relatively benign, while others of the states can be relatively dangerous to the user.

Sequence of sensor data. In an example, a sequence of sensor data is received and maintained in memory/storage as an historical record of state of a relatively complex system.

In one example, the set of sensor data includes a sequence of air mass, or air pressure readings (generally corresponding to pressure measurements) for each of a set of bladders in a cushion. The cushion can be used for seating, such as in a wheelchair, or for lying down, such as in a bed. The cushion can have other uses, such as for easing comfort when seated in automobile or airline travel, or related conditions as described herein.

Predicting system state. In an example, a computing device, such as a processor operating under control of interpretable instructions in memory, is disposed to apply the sequence of sensor data to a model of system behavior, such as a set of transforms which represent how the system responds to sensor data as that sensor data is received. For example, the computing device, when it sees an increase in air mass within the cushion (e.g., without an indicator that a pump is adding air mass to the cushion), can conclude (e.g., using a system model) that the pressure in the cushion has increased and that possibly a weight on the cushion has also increased. The computing device can offload at least some of its simulation of the system state to a logically or physically remote device, with the effect that battery/power drain on the system is relatively reduced. For example, the computing device can offload at least some of its simulation of the system state to a local handheld phone or other mobile device, or using a computing network, to an external server.

State "experiments". The computing device can generate a set of state "experiments", each representing a possible evaluation of the system state in response to a sequence of sensor data. Each state experiment can be derived from a known state experiment believed to be relatively an accurate representation of the state of the system; each state experiment is modified slightly, preferably in a direction that is more likely to make that state experiment a more accurate representation. In one embodiment, the current-best state experiment is modified slightly in a substantially random (or pseudo-random) direction, to provide a new state experiment which can be compared with the sequence of sensor data. In an example, a state experiment involves applying some sensor data to a system model to generate a prediction of a future state of the cushion system, e.g., to predict a future set of sensor data and/or to predict a future condition associated with the system (e.g., the system has a leak, a user is "bottoming out," a user has exited the cushion, the cushion is no longer operational).

Accuracy score. In an example, each state experiment is compared with the sequence of sensor data. A measure of accuracy for the state experiment's "prediction" of following sensor data in response to past sensor data is assigned to the state experiment as an accuracy score. In one embodiment, each state experiment is assigned an accuracy score equal to the mean absolute value of its error from the actual later sensor data, although other possible accuracy scores, such as a root-mean-square (RMS) value or a Frobenius norm, a log-loss score, or a measure of regret, could be used in lieu of, or in addition to, the mean absolute error value.

Consistency of accuracy. In an example, the state experiment's accuracy score can also be combined with other measures, such as whether the state experiment's accuracy score remains consistent (thus, its variance with respect to time) or the state experiment's accuracy score has maintained a high-value for a substantial length of time (thus, its accuracy score has significant longevity). In such cases, the state experiment with the most consistent accuracy score or with the accuracy score with the best longevity might be regarded as the current-best state experiment, particularly if its accuracy score is only a little bit less than an accuracy score for only a recent or inconsistent state experiment.

Repeated state experiments. In an example, the computing device can generate and test state experiments until a termination condition, when it is required to select a current-best state experiment and act upon the enhanced sensor data it was able to glean. In an example, the termination condition can occur when the computing device runs out of historical sensor data and thus must act in response to whatever data it has. The termination condition can occur when the computing device runs out of time or power and thus must act in response to a need to act on the system in real time or before it is out of power. The termination condition can occur when a user demands that the system act on its command, thus, when the computing device can no longer further enhance the sensor data and must act on the user's command. The termination condition can occur on other conditions such as described herein.

Action on enhanced sensor data. In an example, when the computing device acts on its available enhanced sensor data, it repeats the activity of (1) receiving historical sensor data and system parameters; (2) generating state experiments; (3) "predicting" results of those state experiments in response to historical sensor data; (3) comparing results of those state experiments with historical sensor data; (4) assigning accuracy scores to those state experiments; (5) selecting a current-best state experiment in response to those accuracy scores and possibly other factors; and (6) controlling the system in response to its current-best state experiment.

FIG. 1 shows a conceptual drawing of an example system including an enhanced sensor and a processor disposed to perform simulation on raw sensor data.

An example system 100 can include a device, such as a wheelchair 102 having a cushion 110, the cushion possibly having one or more bladders 111, each bladder 111 having at least one sensor 112 disposed to measure an air mass or an air pressure, such as an pressure exceeding an ambient atmospheric pressure. In example environments, the pressure exceeding the ambient atmospheric pressure can be influenced by a weighted object disposed on the cushion 110, such as a person 113 seated thereon or a person 113 seated thereon and holding one or more objects 114 in their lap. With reference to FIG. 1, the cushion includes a sensor 112 for each bladder 111, e.g., multiple bladders and corresponding bladder-specific sensors.

The cushion 110 can include one or more bladders 111, each bladder including a corresponding air mass controller, which may include an inflating pump 115*a* and an deflating valve 115*b*, disposed respectively to increase (e.g., by the pump 115*a*) an amount of air mass within the cushion 110 or to decrease (e.g., by the valve 115*b*) an amount of air mass within the cushion 110. Alternatively, the cushion 110 can include an inflating pump 115*a* disposed to increase the amount of air mass within the cushion 110 and a deflating pump 115*b* disposed to decrease the amount of air mas within the cushion 110. Although not shown in FIG. 1, a cushion system may include the cushion 110 having at least one sensor 112, an air mass controller (e.g., a pump and valve, or a inflating pump/deflating pump for each bladder), and a processor 120 configured so that an air mass within the cushion can be controlled on a per-bladder basis. Operations of the processor, such as prediction and control operations described herein, are represented generally by block 150. It is noted that although only one pump/valve 115*a*/115*b* is shown in FIG. 1, the cushion system may include a separate pump/vale for each bladder, or the cushion system may include fewer pumps/valves than bladders along with an air distribution system (e.g., manifold) that enables pumps/valves to be shared amongst bladders while still providing bladder-specific control of the air mass within a bladder.

The pump 115*a* and valve 115*b*, or the inflating pump 115*a* and deflating pump 115*b*, can operate in response to instructions/commands 152 from a processor 120 (or other controller). For example, each pump 115*a* and valve 115*b* can be controlled by bladder-specific commands generated by the processor 120 in response to bladder-specific sensor data generated by the bladder-specific sensors 112. Such bladder-specific sensing and control allows the cushion 110, the bladders 111, the pump 115*a* and valve 115*b*, or the inflating pump 115*a* and deflating pump 115*b*, the sensors 112 and the processor 120 (as described herein) to operate a feedback loop 154 in which the cushion 110, sensors 112, and processor 120 maintain the cushion 110 in a known desired state (e.g., a safe state) for the person 113 seated thereon.

As illustrated in FIG. 1, the processor 120 can be coupled to the sensors 112 and can be disposed to measure and record the air pressure detected by the sensors 112. The processor 120 can be coupled to memory/storage 121 and can maintain values determined by the sensors 112 in the memory/storage 121 as an historical record 122 of operation of the inflating pump 115*a* and deflating pump 115*b* in response to control signals sent to the cushion 110. In an example, the processor 120 and memory/storage 121 are part of a controller 140 of the cushion system. In one example, the controller is external to the cushion, in another example, the controller is embedded within the cushion, and in another example, a part of the controller is external to the cushion and a part of the controller is embedded within the cushion.

The processor 120 and a system model 123 of how the cushion 110 operates, such as might be maintained using a set of instructions interpretable by the processor 120 to operate on the historical record 120, can determine a sequence of "predicted" values for sensor values. These "predicted" values determine what would be the "future" air pressure determined by the sensors 112, in response to the historical actual values determined by the sensors 112 and in response to the historical record 122 of operation of the control signals sent to the cushion 110.

In one embodiment, the sensors 112 can be disposed to measure a value associated with the inflatable/deflatable cushion 110, such as an amount of air mass entering/exiting a bladder 111 of the cushion 110, an air pressure in the cushion 110 (e.g., on a per-bladder basis), or otherwise as described herein. For example, air pressure in the cushion 110 can be determined as an absolute air pressure on a per-bladder basis, as an air pressure relative to an ambient air pressure, or otherwise as described herein. One effect of using an air pressure relative to an ambient air pressure is that the air pressure in a bladder of the cushion 110 can be automatically adjusted in response to changes in ambient air pressure; for example, when the cushion 110 is used with respect to air travel, the cushion 110 would automatically adjust to reduced ambient air pressure and thus not overinflate.

Receiving sensor values. In one example, the processor 120 can receive (or request) sensor values from the sensors 112 relatively frequently, such as one such sensor value per sensor each few milliseconds. Alternatively, the processor 120 can receive (or request) sensor values more slowly or more quickly, such as each few microseconds or such as a few sensor values each second. Alternatively, the processor 120 can receive (or request) sensor values more frequently when it has more processing capability available and less frequently when it has less processing capability available.

In one example, the processor 120 can operate at relatively low power, such as operating during a "sleep" state or other inactive state of the cushion 110. For example, the processor 120 can be disposed to use less than about 300 milliwatts of power when operating, or less than about 1 milliwatt of power when idle. Alternatively, the processor 120 can be disposed to use more or less power in response to a state of a battery available to the cushion 110 and/or processor 120.

In one example, the processor 120 can receive (or request) sensor values from the sensors 112 and maintain about 2-3 Kilobytes of sensor values as compressed data, thus, about 2500 sensor values. For example, the raw data for the sensor values can be received at about 12 bits for each sensor value and compressed using a variable number of bits for each value. When sensor values are received/requested at about 125 Hz (thus, each 8 milliseconds), the processor 120 can maintain a buffer of about 20 seconds of data. In such cases, the data can include both sensor values and the control state of the cushion 110 at each time when a sensor value is collected.

In one example, the processor 120 can maintain the buffer with a larger number of sensor values when the current-best system experiment is relatively uncertain, relatively inaccurate, or otherwise insufficient. The processor 120 can also maintain the buffer with a larger number of sensor values when memory becomes available that was otherwise allocated to other uses, such as memory that is generally reserved for software/data updates but is not currently needed for those updates.

While this Application describes a system in which a history of sensor values is maintained using lossless compression, there is no particular requirement for any such limitation. For example, the processor 120 can maintain a greater amount of history using a lossy compression technique. In such cases, the processor 120 can be disposed to select an amount of loss for the compression technique in response to one or more factors relating to a status of the system 100 or of one or more system experiments. For example, the processor 120 can be disposed to maintain a greater amount of data using a more lossy compression technique in cases in which the user has not moved frequently (thus, the system 100 is more easily predictable), or in cases in which the current-best system experiment has a relatively good accuracy score, or otherwise when the processor 120 has relatively good confidence of a state of the system 100.

Performing system "experiments". In one example, the processor 120 and a system model 123 of how the cushion 110 operates, such as might be maintained using a set of instructions interpretable by the processor 120 to operate on the historical record 122, can determine a sequence of "predicted" values for sensor values. These "predicted" values determine what would be the "future" air pressure determined by the sensors 112, in response to historical actual values determined by the sensors 112 and in response to the historical record 122 of operation of the control signals sent to the cushion 110. In an example, historical records 122 and at least one system model 123 are stored in the memory/storage 121 as illustrated in FIG. 1.

In one example, the processor 120 can select each system experiment to perform in response to a current-best system experiment and selecting a dimension of that system experiment to alter. For example, the processor 120 can be disposed to select the dimension to alter at random, in response to a sensor value which has a currently greatest variance, in response to a sensor value which has a currently greatest contribution to an error score (thus for example, a currently greatest contribution to reducing an accuracy score), in response to a sensor value which is currently most unpredictable (such as action by a human user, or such as another stochastic element of the system 100), or in response to a sensor value for which an error is currently most likely to result in an untoward system configuration (such as the cushion 110 "bottoming out" and allowing the user to press against a support surface).

In one example, the processor 120 can generate a new system experiment in response to altering a current-best system experiment (or altering a different system experiment) by randomly modifying a selected sensor value. For example, the processor 120 can modify the selected sensor value using a uniform probability distribution with a width of about +/−70 milligrams of air mass. Alternatively, the processor 120 can modify the selected sensor value using a Gaussian probability distribution, such as a distribution having a mean of zero and a standard deviation of about 35 milligrams of air mass. In such cases, the processor 120 can be disposed to use a wider random distribution if all (or nearly all) of the system experiments have relatively poor accuracy scores, or if the user is relatively active (thus, leading to relative uncertainty by all or nearly all system experiments). In such cases, the processor 120 can be disposed to use a narrower random distribution if the cushion 110 is near an untoward condition, such as a "bottoming out" state.

In one embodiment, the processor 120 can determine one or more states associated with an untoward condition (such as a "bottoming out" state) and can be disposed to avoid the one or more states associated with that untoward condition. For example, when the person 113 first sits/lays on the cushion 110, the processor 120 can:

- inflate the cushion 110 to a known state (e.g., by generating commands that control the pump 115*a*);
- bleed pressure out of the cushion 110 using one or more of the pump/valve 115*a*/115*b* or of the inflating/deflating pump 115*a*/115*b* until the untoward condition is reached (such as a "bottoming out" state) (e.g., by generating commands that control pumps/valves 115*b*);
- determine one or more sensor states associated with that untoward condition; and
- avoid configurations of the system 100 which have those sensor states, or which are within a threshold near those sensor states.

In such cases, the processor 120 can avoid those untoward conditions in response to system experiments, independently, or otherwise as described herein. For example, the processor 120 can override system experiments to avoid untoward conditions such as "bottoming out", can avoid untoward conditions independently of system experiments, or can otherwise avoid untoward conditions as described herein.

In one example, the processor 120 can be disposed to maintain a current-best system experiment. For example, the processor 120 can be disposed to update the current-best system experiment when it discerns a new system experiment with a better accuracy score. In another example, the processor 120 can update the current-best system experiment only when it discerns a new system experiment that has an accuracy score which is better by a selected threshold, such as 0.1% better to 0.5% better. For another example, the processor 120 can update the current-best system experiment only when it discerns a new system experiment that has an accuracy score which is both better and which has sufficient longevity that it concludes that the better accuracy score is representative of the system experiment. In such cases, the processor 120 might look for an accuracy score which stays better than the previous current-best accuracy score by at least 10 to 20 seconds. Alternatively, the processor 120 might look for an accuracy score which is 0.1% better than the previous current-best accuracy score for each 20 seconds of longevity attributable to the previous current-best accuracy score. For another example, the processor 120 can update the current-best system experiment only when it discerns a new system experiment that has an accuracy score which shows a lower probability of an undesired system event, such as "bottoming out" (as described herein). Alternatively, the processor 120 can update the current-best system experiment otherwise as described herein.

Terms "predicted" and "future". As used herein, the terms "predicted" values and "future" air pressure may indicate that the memory 121 and the historical record 122 have already recorded actual historical values of those values and air pressure. However, they are determined by the processor 120 and the system model 123 in response to data they receive and which they compute to follow in the future from what information they have. As described herein, the "predicted" values and "future" air pressure can later be compared with actual past values to determine an accuracy value for how well the processor 120 and the system model 123 actually predicted the future in response to information they receive from the sensors 112.

In one embodiment, the processor 120 can determine "predicted" values at a rate that substantially exceeds the rate at which the sensors 112 generate actual data values. For example, the processor 120 might be disposed to determine "predicted" values at a rate of about 100 times the rate at which the sensors 112 generate actual data values. This would allow the processor 120 to perform a relatively large number of system experiments while concurrently collecting sensor values from the sensors 112. Having performed the system experiments, the processor 120 would be able to select (A) a current-best system experiment; and (B) a mean and standard deviation, or at least a probability distribution, of each of a set of new sensor values.

In one embodiment, the processor 120 can determine a selected set of commands to send to the pump 115*a* and/or the deflating valve 115*b*, to achieve a desired set of sensor values. For example, the desired set of sensor values can be disposed to avoid an untoward system configuration or state, such as preventing the user from "bottoming out" (thus, failing to be supported by the cushion 110 against pressure from an underlying surface). For example, the selected set of commands can be in response to a current-best system experiment, a probability distribution of sensor values, a combination of system experiments, or otherwise as described herein.

Offloading computation remotely. Although the processor 120 and the system model 123 are shown in FIG. 1 as being disposed locally to the cushion 110, in the context of the invention, there is no particular requirement for any such limitation. For example, the processor 120 can offload at least some of its computation to logically remote computing resources 130, such as a logically remote database 124 or a logically remote server 125.

For example, the processor 120 can make ordinary predictions using the system model 123 which is relatively easy to compute, and periodically (or otherwise from time to time) offload computation to a more relatively more powerful processor 126 or a relatively more accurate system model 127 to determine whether it is performing accurate predictions.

For another example, the processor 120 can make ordinary predictions using more than one (relatively easy to compute) system model 123 and can offload computation to the relatively more powerful processor 126 or the relatively more accurate system model 127 whenever those relatively easy to compute system models 123 disagree.

For another example, the processor 120 can make ordinary predictions using more than one (relatively easy to compute) system models 123 and can offload computation to the relatively more powerful processor 126 or the relatively more accurate system model 127 whenever the processor 120 has sufficient extra time or power to use the more powerful processor 126 without unduly delaying its predictions.

For another example, the processor 120 can make ordinary predictions using relatively easy to compute system models 123 for a first set of sensors 112 and can offload computation to the relatively more powerful processor 126 or the relatively more accurate system model 127 whenever the processor 120 has sufficient extra time or power to use the relatively more powerful processor 126 or the relatively more accurate system model 127 for additional or distinct sensors 112.

For another example, the processor 120 can make ordinary predictions using a first system model 123 which includes a linearization of a second system model 123 which is otherwise relatively more difficult to compute. In such cases, the processor 120 can request another processor (such as the relatively more powerful processor 126) to linearize the relatively more accurate system model 127, such as to perform ordinary predictions using a linearized system model. The processor 120 can also be disposed to re-request linearization when the linearized system model becomes inaccurate or otherwise insufficient.

In one embodiment, the processor 120 can offload at least some of its computation to a relatively locally available alternative processor, such as a smartphone or other mobile device it might find in the vicinity. For example, processor 120 can be disposed to offload at least some of its computation to a smartphone available or other mobile device available via Bluetooth™ or Wi-Fi, such as a smartphone owned or used by a user of the cushion 110. For example, the processor 120 can be disposed to communicate with an app on the user's smartphone to perform at least some of the predictions using one or more system models 123. For example, the smartphone can be disposed to perform offloaded computation when (A) the processor 120 is overloaded, (B) the processor 120 can use the assistance of additional computational substrate, (C) the processor 120 can use the assistance of additional processing capability, such as a parallel processor, (D) the processor 120 can use the relatively more powerful processor 126 or the relatively more accurate system model 127, such as described with respect to "offloading computation remotely", or otherwise as described herein.

In one embodiment, the processor 120 can be disposed to control the cushion 110 using a current-best system experiment, such as a system experiment which provides a best set of "predicted" sensor values. In such cases, when all such system experiments are inaccurate or otherwise insufficient, the processor 120 can be disposed to use the least-bad such system experiment and to alert the user (or a caregiver) that it needs assistance. With reference to FIG. 1, prediction and control operations 150 are performed by the processor 120 and/or the processor 126 as described herein. Such prediction and control operations may utilize the historical record 122 and/or system model 123.

Figure 2:
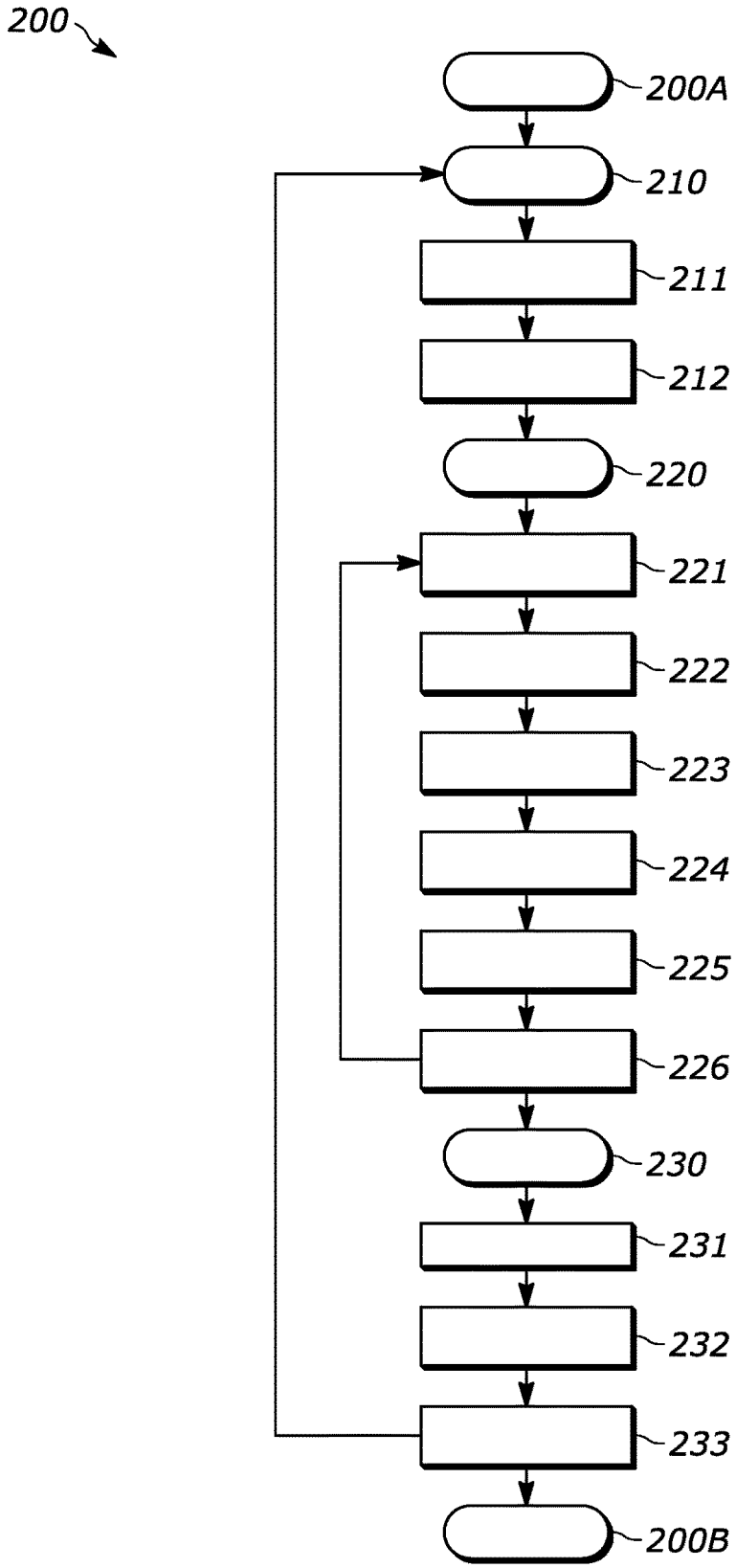
FIG. 2 depicts an example process flow diagram of a technique for operating a cushion system such as the cushion system shown in FIG. 1.

FIG. 2 depicts an example process flow diagram of a technique for operating a cushion system such as the cushion system shown in FIG. 1. Although the steps of the method 200 are described herein as performed by the method 200, in practice the steps of the method 200 are performed by individual elements of the system 100 (FIG. 1), or by one or more elements of the system 100 operating in cooperation. Where the specific elements of the system 100 disposed to perform the method 200 are not specified, the particular elements of the system 100 disposed to perform those portions of the method 200 would be clear to those of ordinary skill in the art in light of the specification.

Although the steps of the method 200 are necessarily described in a sequence, in practice the steps can be performed in parallel, pipelined, coroutined, or using another technique which is not necessarily sequential. For example, as described herein with respect to offloading computing to alternative substrate, it is possible for at least some computing functions to be performed by alternative substrate, upon demand or when insufficient resources are available to timely perform necessary functions, or when excess alternative substrate is available to speed up or otherwise improve operation.

Ready to start. At a flow point 200A, the method 200 is ready to start. The method 200 can be triggered by, for example, an input by a caregiver (not shown) or the user 113, by a change in state by, for example, the system 100, by passage of a duration of time, or by another trigger associated with the nature of the system 100.

Receive sensor information. At a flow point 210, the method 200 is ready to receive sensor information from the system 100.

At a step 211, the method 200 receives information from one or more of the sensors 112, such as by the processor 120. The information received from the sensors 112 can include air mass or air pressure in each of the bladders 111, control sequences directed to one or more of the system 100 devices, such as directions to control the pumps 115*a* or valves 115*b*, or other portions thereof. As part of this step, the information from one or more of the sensors 112 can be used by the method 200, such as by the processor 120 operating the system model 123, to "predict" the "future" values of the sensors 112 as they are maintained in memory/storage 121 and/or to predict a state of the system or a state associated with the system.

At a step 212, the method 200 stores and maintains the information (e.g., sensor data) from one or more of the sensors 112 in its memory/storage 121. As described herein, the processor 120 can store and maintain the information from one or more of the sensors 112, not necessarily all of them, at a logically remote computing substrate, such as the logically remote database 124. The processor 120 can thereafter retrieve that information from the logically remote database 124 such as by a request from the logically remote server 125.

Experiment with state information. At a flow point 220, the method 200 is ready to determine enhanced state information. As described herein, the processor 120 can generate one or more "state experiments" to attempt to determine an accurate state of the system 100, the state experiments being disposed to determine consistency between the raw sensor information and "predicted" sensor information, thus, to determine whether raw sensor information as earlier received from the system 100 is consistent with sensor information as later received from the system 100.

The terms "predicted" values and "future" air pressure indicate that the memory 121 and the historical record 122 have already recorded actual historical values of those values and air pressure. However, they are determined by the processor 120 and the system model 123 in response to data they receive and which they compute to follow in the future from what information they have. As described herein, the "predicted" values and "future" air pressure can later be compared with actual past values to determine an accuracy value for how well the processor 120 and the system model 123 actually predicted the future in response to information they receive from the sensors 112.

At a step 221, the method 200 generates a state experiment in response to its then-current information for its best experiment. When the method 200 has just started at the flow point 200A, it can use a randomly generated best experiment set of parameters as its then-current best experiment. When the method 200 has restarted after finishing at the flow point 200B, it can use a best experiment generated in response to its then-determined best experiment from the flow point 200B. The method 200 can use the actual then-determined best experiment from the flow point 200B, or the method 200 can use a relatively small adjustment to the best experiment it determined from the flow point 200B.

At a step 222, the method 200 generates a sequence of "predicted" states in response to its then-current best experiment, as updated by sensor information from one or more sensors 112 and/or control information with respect to the inflating pump 115*a* and deflating pump 115*b*. The processor 120 applies the system model 123, or the processor 120 and the system model 123 outsource computing substrate to the relatively more powerful processor 126 and/or the relatively more accurate system model 127, to generate a sequence of "predicted states" states in response to its then-current best experiment. In an example, a predicted state is a set of predicted sensor values, in which the set of predicted sensor values are predicted by a system model in response to receiving a set of actual sensor values from the sensors 112. For example, the set of predicted sensor values are a prediction of sensor values at some time in the future relative to the set of actual sensor values that have been received from the sensors 112. In another example, a predicted state is a prediction of a state of the system (e.g., the system has a leak, a user has "bottomed out", a user has exited the cushion) that is made by a system model in response to receiving a set of sensor values from the sensors 112.

At a step 223, the method 200 compares the "predicted states" with its stored recorded states it received from the one or more sensors 112. As part of this step, the processor 120 determines whether its "predicted states" are sufficiently close to the accurate recorded states it received from the one or more sensors 112. The processor 120 determines a score for the "predicted" states and associates that score with the state experiment which generated those predicted states.

(Method of scoring.) There are many different ways in which the processor 120 can score each "precited" state, each of which might be best-suited for a particular system model 123 and/or a particular technique for searching for a best state experiment. It has been found that the mean absolute value of error is a superior technique for scoring state experiments. Thus, for each data point provided by a sensor 112, the processor 120 can determine an error value from the "predicted" sensor value, determine an absolute value of that error value (thus, providing an always-non-negative score), and determine a mean (thus, average) of those error values. Although this technique is deemed superior, other techniques would also be acceptable, either in this or other circumstances. A mean square of error would also be acceptable. A Frobenius norm would also be acceptable. Other known techniques known in the fields of computer science, statistics, data science, artificial intelligence or machine learning (AI/ML) would also be acceptable.

At a step 224, the method 200 determines the stored accuracy for each available state experiment and compares each state experiment with each other state experiment for the best available stored accuracy.

At a step 225, the method 200 determines which state experiment has the best available accuracy and determines that state experiment to be the new current-best state experiment.

At a step 226, the method 200 determines whether it has reached a termination condition, at which point it stops attempting to find a better new best state experiment. The termination condition can occur when the method 200 is out of information from the one or more sensors 112, and thus must act without any further sensor 112 information. Alternatively, the termination condition can occur when the method 200 is out of time in which to compute enhanced sensor information, and thus must act without attempting to find a better new best state experiment. Alternatively, the termination condition can occur when the method 200 is unable to improve the current-best state experiment by a significant amount (e.g., by more than a threshold amount), and thus chooses to act without attempting to find a better new best state experiment. Other and further termination conditions can exist, such as described herein.

Current best state is known. At a flow point 230, the method 200 is ready to act upon the best state experiment.

At a step 231, the method 200 predicts/determines its current-best estimated state (as described by its current-best state experiment) and compares that current-best estimated state with its desired state. As part of this step, the method 200 may determine a difference between its current-best estimated state and its desired state, and any activity necessary to reach its desired state from its current-best estimated state. For example, if the method 200 determines that its desired state involves a selected amount of air mass within the cushion 110 and its current-best estimated state is that the air mass within the cushion 110 is much less than the selected amount, then the method 200 can determine that it needs to increase the air mass within the cushion 110 to its desired amount.

At a step 232, the method 200 determines a sequence of commands to direct the pumps 115*a* and/or valves 115*b* to achieve its desired state in response to the comparison at step 231. As part of this step, the method 200 issues the determined sequence of commands to the pumps 115*a* and/or valves 115*b* in an attempt to achieve its desired state. For example, a sequence of bladder-specific commands are issued to control the bladders individually on a per-bladder basis.

At a step 233, the method 200 continues with the flow point 210, until it determines it has reached, or is sufficiently close to, its desired state. If it is determined that a desired state has been reached, the method 200 proceeds with the flow point 200B, where it reaches a termination condition. If its desired state changes between the flow point at the step 233, the method 200 continues until it reaches a termination condition. Otherwise, the method 200 continues until it reaches its desired state, or otherwise reaches a termination condition. In another example, if the desired state has not been reached at step 233, then the process returns to step 231 and repeats steps 231-233 until the desired state is reached.

Finish method and restart. At a flow point 200B, the method 200 is ready to finish. The method 200 can determine it is ready to finish when it reaches a termination condition (as described with respect to the step 233 above), e.g., when it is terminated by a caregiver or the user 113, when it runs out of power, or otherwise as described herein.

The method 200 can be restarted at the flow point 200A when triggered by a starting condition, such any of the starting conditions described therein.

Figure 3:
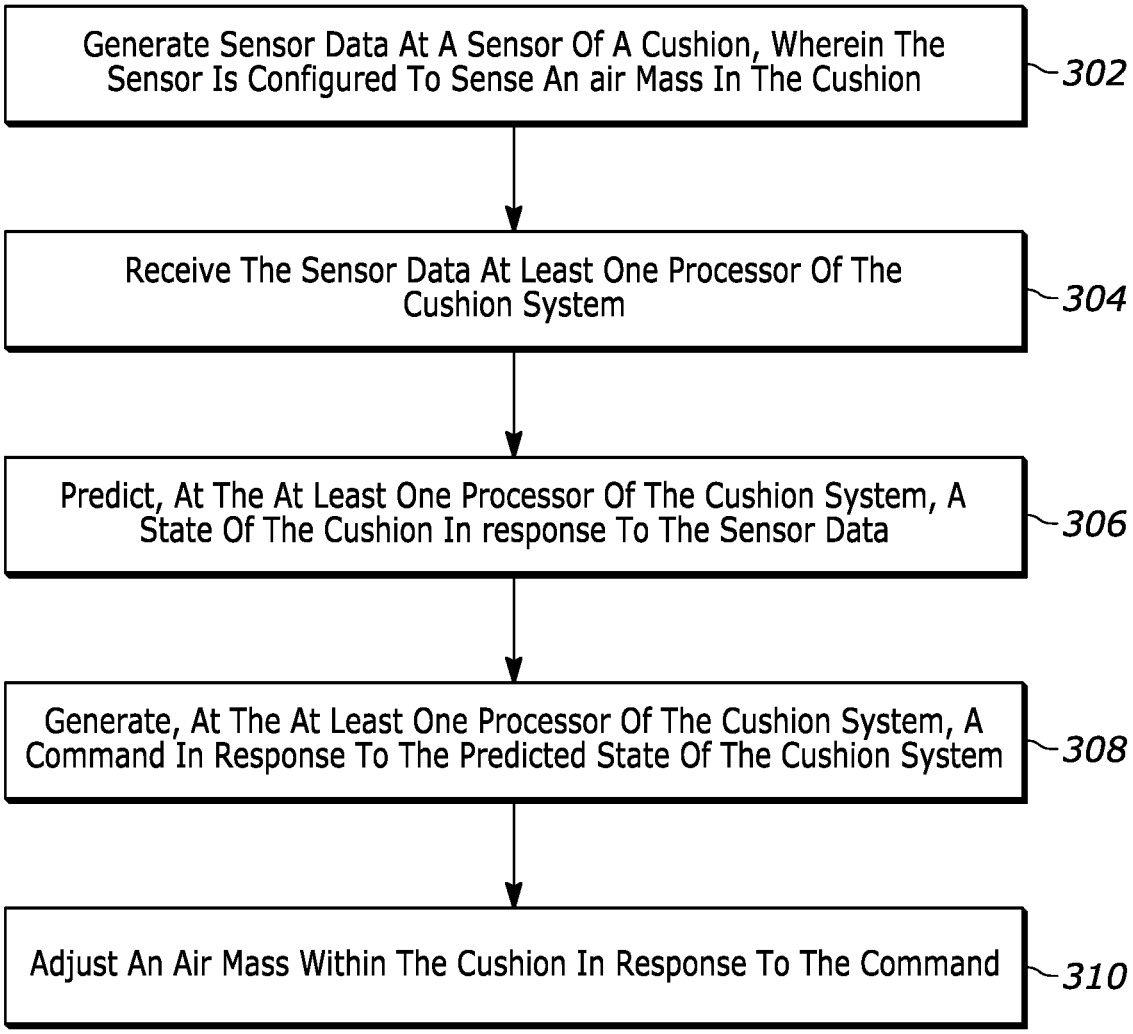
FIG. 3 is a process flow diagram of a technique for operating a cushion system.

FIG. 3 is a process flow diagram of a technique for operating a cushion system. At block 302, sensor data is generated at a sensor of a cushion, wherein the sensor is configured to sense an air mass in the cushion. At block 304, the sensor data is received at at least one processor of the cushion system. At block 306, at the at least one processor of the cushion system, a state of the cushion is predicted in response to the sensor data. At block 308, at the at least one processor of the cushion system, a command is generated in response to the predicted state of the cushion system. At block 310, an air mass within the cushion is adjusted in response to the command.

What is also disclosed includes a method of detecting a system state, the method including steps of: receiving a set of historical sensor data from an element in the system; simulating a system state in response to the sensor data; comparing the simulated system state with the sensor data; selecting a next state estimate in response to the simulated system state.

The method as described above, wherein the steps of simulating a system state including steps of selecting a state estimate in response to the sensor data; determining a predicted system state in response to the sensor data; determining a next predicted system state in response to each predicted system state; determining an associated set of sensor data in response to each next predicted system state. The method as described above including steps of comparing each set of sensor data associated with a set of sensor data with the set of historical sensor data; associating an accuracy score with each simulated system state; selecting a current-best simulated system state in response to its associated accuracy score.

An enhanced cushion is also disclosed. The enhanced cushion including a bladder disposed to be inflated/deflated under control of a pump; a sensor coupled to the bladder; a processor coupled to the sensor and disposed to simulate operation of the bladder in response to inputs from the sensor; the pump being coupled to the bladder, disposed to inflate/deflate the bladder, and operating under control of the processor.

The cushion as described above, wherein the processor is disposed to receive a set of historical sensor data from the sensor; the processor is disposed to provide a set of predicted sensor data in response to the historical sensor data; the processor is disposed to compare the predicted system state with the historical sensor data; the processor is disposed to inflate/deflate the bladder in response to the predicted system state.

A control feedback system is also disclosed. The feedback control system including a sensor disposed to receive information with respect to a state of the system; a processor coupled to the sensor and disposed to simulate operation of the system in response to inputs from the sensor; a control element coupled to the processor, disposed to alter a state of the system in response to control of the processor. The feedback control system as described above, including a buffer disposed to maintain a set of historical sensor data received with respect to states of the system; a set of instructions the processor is disposed to interpret to compare a simulation of operation of the system with the set of historical sensor data; a set of instructions the processor is disposed to interpret to associate an ac-curacy score with a selected simulation of the system; wherein the control element is responsive to the accuracy score associated with at least one of the selected simulations of the system.

An enhanced sensor is disclosed. The enhanced sensor including a raw sensor disposed to receive information with respect to a state of a system; and a processor coupled to the raw sensor and disposed to determine a simulated system state in response to inputs from the raw sensor; the processor being disposed to compare the simulated system state with the raw sensor data; the processor being disposed to estimate a system state in response to the simulated system.

An enhanced cushion is disclosed. The enhanced cushion including a processor disposed to inflate the cushion to a known state; one or more deflating pumps or valves disposed to deflate the cushion until a known untoward condition is approached or reached; the processor being disposed to determine one or more sensor states associated with the untoward condition; and the enhanced cushion being disposed to avoid configurations which have one of those one or more sensor states, or which are within a threshold of those one or more sensor states. The enhanced cushion as described above, wherein the untoward condition includes a bottoming out state.

Another example, of an enhanced cushion is disclosed. The enhanced cushion including a processor disposed to inflate the cushion to a known state; one or more sensors coupled to the processor and disposed to measure a value associated with the cushion; and one or more inflating/deflating pumps or valves disposed to inflate/deflate the cushion in response to the processor. The enhanced cushion as described above, wherein the value associated with the cushion includes one or more of: an amount of air mass entering/exiting the cushion, an air pressure in the cushion, or an air pressure in the cushion relative to an ambient air pressure.

Also disclosed herein, data from sensors is collected for a system. A model is applied, predicting system behavior in response. "Prediction" relates how the system should behave before historical data is collected, in response to some of that historical sequence and after that historical sequence was collected. New models are measured for accuracy; a best model is selected to issue system commands. Additional sensor data allows better system models to be added. Separate system models are maintained for distinct uses: a first model which is easy to compute and a second model which is which is more accurate. When the first model is inadequate, the enhanced sensor offloads computation, obtaining more reliable prediction. Alter-natively, first and second computable models each provide separate predictions of system behavior; when they disagree, a harder to compute model is used to distinguish between them. Offloading computation is performed to a remote computing device, or to relatively more local allocable devices.

While this Application primarily describes systems and techniques that relate to enhancing sensors, particularly with respect to inflatable/deflatable cushions, and with respect to making it easier and more effective for a processor to determine a state of a device, particularly an inflatable/deflatable cushion, there is no particular requirement for any such limitation. For example, techniques described herein can be disposed to assist with or control perception by an operator or a passenger in a vehicle or other moving structure, can be disposed to assist with or control operation by an operator or another viewer in a recon-naissance device or other viewing structure (whether moving or otherwise), can be disposed to assist with or control perception of a presentation (such as a body camera or a security camera, a field test or other examination, a show or a sporting event, a field of view for an operator or a passenger of a vehicle, or otherwise as described herein), a control system such as an oil refinery or a network control system, or otherwise as described herein.

While this Application primarily describes systems and techniques that relate to enhancing sensors and/or determining states of complex, nonlinear systems, or which relate to determining status of a potentially complex or nonlinear deterministic or stochastic system; there is no particular requirement for any such limitation. For example, techniques described herein can be disposed to assist with respect to feedback and/or control of such systems, whether or not the system is easily or relatively easily controllable or understandable: such as use with respect to an artificial intelligence or machine learning (AI/ML) training system, a chemical processing plant, a combat control system, a hydroelectric system, a network monitoring system, a nuclear reactor, an oil refinery, a personnel training system, a robotic control system, a traffic monitoring system, or otherwise as described herein.

After reading this Application, those skilled in the art will recognize that the techniques described herein are applicable to a wide variety of types of de-vices, methods, and/or systems. Moreover, those skilled in the art will recognize that the techniques described herein are applicable to a wide variety of control techniques, including those which are controlled by a human operator, those which are controlled remotely (such as a remote-controlled airplane a drone, or otherwise as described herein), those which are controlled in co-operation by an operator and an instructor or other external controller, those which are self-controlled (such as a "self-driving car", a missile, or otherwise as described herein) or otherwise controlled by a control program (whether disposed locally or re-motely, or some combination thereof), or otherwise as described herein.

This Application describes a preferred embodiment with preferred process steps, preferred data structures, and, where applicable, preferred control structures or control systems. After reading this Application, those skilled in the art would recognize that, where any calculation or computation is appropriate, embodiments of the description can be implemented using general purpose computing devices or switching processors, special purpose computing devices or switching processors, other circuits adapted to particular process steps and data structures described herein, or combinations or conjunctions thereof, and that implementation of the process steps and data structures described herein would not require undue experimentation or further invention.

The claims, and all terms therein, are hereby incorporated into the specification by reference as if fully set forth herein.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Alternatively, embodiments of the invention may be implemented entirely in hardware or in an implementation containing both hardware and software elements. In embodiments which use software, the software may include but is not limited to firmware, resident software, microcode, etc.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A system, comprising:

an inflatable support member having at least one bladder;

at least one sensor disposed to sense at least one value associated with the inflatable support member including an air pressure in the at least one bladder or an air pressure relative to ambient;

a controller configured to control an internal fluid quantity within the inflatable support member; and a processor coupled to a memory storing an historical record comprising (i) sensor data obtained from the at least one sensor and (ii) control information indicative of prior control commands issued to the controller, wherein the processor is configured to:

apply a system model to the historical record, including the prior control commands and the sensor data, generate predicted states including a current-best estimated state that comprises an estimated amount of internal fluid quantity within the inflatable support member, and provide a command to the controller in response to the estimated state to adjust the internal fluid quantity within the inflatable support member.

2. The system of claim 1, wherein the controller includes a pump configured to inflate a bladder of the inflatable support member in response to the command.

3. The system of claim 1, wherein the controller includes a valve configured to deflate a bladder of the inflatable support member in response to the command.

4. The system of claim 1, wherein the processor is further configured to generate a plurality of state experiments that each apply the system model to at least a portion of the sensor data to produce predicted future sensor values or a predicted state or both, determine, for each state experiment, an accuracy score and one or more of a consistency measure or a longevity measure for that accuracy, select the current-best state experiment in response to the accuracy score and the one or more measures, and determine and store, in the memory, one or more regions in a sensor-state space associated with an untoward condition from the comparisons.

5. The system of claim 4, wherein the one or more sensor-state regions associated with an untoward condition comprise a region indicative of the inflatable support member having a leak in response to the sensor data.

6. The system of claim 4, wherein the one or more sensor-state regions associated with an untoward condition comprise a region indicating that a user of the inflatable support member is pressing against a supporting surface underneath the inflatable support member.

7. The system of claim 4, wherein the one or more sensor-state regions associated with an untoward condition comprise a region indicating that a user of the inflatable support member has exited the inflatable support member.

8. The system of claim 4, wherein the one or more sensor-state regions associated with an untoward condition comprise a region indicative that the inflatable support member is no longer operational.

9. The system of claim 1, wherein the system model is parameterized by one or more of prior control actions, ambient conditions, and user load.

10. The system of claim 1, wherein the processor is configured to initiate a safety procedure in which the inflatable support member is inflated to a known state and then deflated until a bottoming-out condition is reached to determine one or more sensor states associated with that bottoming-out condition, and avoid configurations at or within a threshold of those sensor states during routine operation of the system.

11. The system of claim 1, wherein the inflatable support member includes multiple bladders, each bladder including a bladder-specific sensor, and wherein the processor receives bladder-specific sensor data from the multiple bladders.

12. The system of claim 11, wherein the processor is configured to provide bladder-specific commands in response to the bladder-specific sensor data.

13. The system of claim 1, wherein the inflatable support member is a cushion.

14. The system of claim 1, wherein the internal fluid quantity of the inflatable support member is an air mass of the inflatable support member.

15. A method of operating a system, comprising:

generating sensor data at a sensor of an inflatable support member, wherein the sensor is configured to sense an internal fluid quantity in the inflatable support member;

receiving, at at least one processor of the system, the sensor data of the inflatable support member;

predicting a state of the inflatable support member by:

applying a system model to an historical record, the historical record comprising (i) sensor data obtained from the sensor and (ii) control information indicative of prior control commands issued to a controller, generating predicted states including a current-best estimated state that comprises an estimated amount of internal fluid quantity within the inflatable support member;

in response to the estimated state, commanding the controller to adjust the internal fluid quantity within the inflatable support member; and adjusting the internal fluid quantity in response to the command to the controller.

16. The method of claim 15, wherein adjusting the internal fluid quantity within the inflatable support member involves inflating at least one bladder of the inflatable support member in response to the command.

17. The method of claim 15, wherein adjusting the internal fluid quantity within the inflatable support member involves deflating at least one bladder of the inflatable support member in response to the command.

18. The method of claim 15, wherein the processor is configured to initiate a safety procedure in which the inflatable support member is inflated to a known state and then deflated until a bottoming out condition is reached to determine one or more sensor states associated with that bottoming-out condition, and avoid configurations at or within a threshold of those sensor states during routine operation of the system.

19. The method of claim 15, wherein predicting the state of the inflatable support member associated with an untoward condition comprises a region indicating one or more of the following:

that the inflatable support member has a leak in response to the sensor data, that the inflatable support member is pressing against a supporting surface underneath the inflatable support member, that a user of the inflatable support member has exited the inflatable support member, and that the inflatable support member is no longer operational.

20. The method of claim 15, wherein the inflatable support member is a cushion.

21. The method of claim 15, wherein the internal fluid quantity of the inflatable support member is an air mass of the inflatable support member.

* * * * *